US008362912B2

(12) United States Patent
Botting et al.

(10) Patent No.: US 8,362,912 B2
(45) Date of Patent: Jan. 29, 2013

(54) METHOD AND APPARATUS FOR PREVENTING HITTING IN A RESTRICTED ZONE DURING GAME PLAY

(75) Inventors: Kevin Botting, Elk Point (CA); Rocky Botting, Elk Point (CA)

(73) Assignee: Kevin Botting, Elk Point (CA)

( * ) Notice: Subject to any disclaimer, the term of this patent is extended or adjusted under 35 U.S.C. 154(b) by 268 days.

(21) Appl. No.: 12/442,106

(22) PCT Filed: Sep. 19, 2007

(86) PCT No.: PCT/CA2007/001654

§ 371 (c)(1), (2), (4) Date: Mar. 19, 2009

(87) PCT Pub. No.: WO2008/034230

PCT Pub. Date: Mar. 27, 2008

(65) Prior Publication Data

US 2009/0243871 A1 Oct. 1, 2009

Related U.S. Application Data

(60) Provisional application No. 60/845,706, filed on Sep. 19, 2006.

(30) Foreign Application Priority Data

Oct. 23, 2006 (CA) ..... 2566065

(51) Int. Cl.
*G08B 21/00* (2006.01)

(52) U.S. Cl. ..... 340/686.6; 340/686.1; 340/539.23; 340/539.13; 340/573.1; 340/561; 340/564; 340/323 R; 473/467; 473/471; 463/1

(58) Field of Classification Search ..... 340/686, 340/686.1, 686.6, 539.1, 539.23, 539.13, 340/573.1, 561, 564, 323 R; 473/467, 471; 463/1

See application file for complete search history.

(56) References Cited

U.S. PATENT DOCUMENTS

| | | | | | |
|---|---|---|---|---|---|
| 3,774,194 | A | * | 11/1973 | Jokay et al. | 473/467 |
| 3,883,860 | A | * | 5/1975 | von Kohorn | 473/467 |
| 4,092,634 | A | * | 5/1978 | Von Kohorn | 473/467 |
| 4,648,131 | A | | 3/1987 | Kawaguchi | |
| 4,763,275 | A | * | 8/1988 | Carlin | 702/41 |

(Continued)

FOREIGN PATENT DOCUMENTS

| | | | |
|---|---|---|---|
| CA | 2555249 | A1 | 8/2005 |
| JP | 2007-102285 | A | 4/2007 |

(Continued)

OTHER PUBLICATIONS

International Search Report mailed Feb. 28, 2008, in corresponding International Patent Application No. PCT/CA2007/001654.

*Primary Examiner* — George Bugg
*Assistant Examiner* — Ojiako Nwugo
(74) *Attorney, Agent, or Firm* — Christensen O'Connor Johnson Kindness PLLC

(57) ABSTRACT

An apparatus for preventing hitting in a restricted zone during game play includes a signal generator for signaling the location of a restricted zone in a playing area contained by a barrier. A proximity detector receives the signal generated by the signal generator. An indicator indicates when the proximity detector is within the restricted zone, the signal generator and the indicator being carried by a player.

12 Claims, 2 Drawing Sheets

U.S. PATENT DOCUMENTS 5,954,599 A * 9/1999 Lin ..... 473/467
6,270,433 B1 * 8/2001 Orenstein et al. ..... 473/467
6,487,992 B1 12/2002 Hollis
7,327,251 B2 * 2/2008 Corbett, Jr. ..... 340/539.13
7,421,979 B2 * 9/2008 Kim ..... 119/721
7,901,306 B2 * 3/2011 Minarovic ..... 473/490
2003/0151515 A1 8/2003 Yuzuki
2007/0135243 A1 6/2007 LaRue
2008/0083054 A1 * 4/2008 Vaccari et al. ..... 2/425

FOREIGN PATENT DOCUMENTS

WO 2006/094508 A1 9/2006

* cited by examiner

METHOD AND APPARATUS FOR PREVENTING HITTING IN A RESTRICTED ZONE DURING GAME PLAY

FIELD

The present application relates to a method and apparatus for preventing hitting in a restricted zone during game play.

BACKGROUND

Injuries in sports, such as hockey and lacrosse, occur when players are checked in to the boards that define the playing surface. Rules have been enacted for some hockey and lacrosse leagues that prohibit checking in restricted areas adjacent to the boards, but injuries continue to occur.

SUMMARY

There is provided a method and associated apparatus for preventing hitting in a restricted zone during game play, including a signal generator for signaling the location of a restricted zone in a playing area contained by a barrier. A proximity detector receives the signal generated by the signal generator. An indicator indicates when the proximity detector is within the restricted zone, the signal generator and the indicator being carried by a player.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 3:
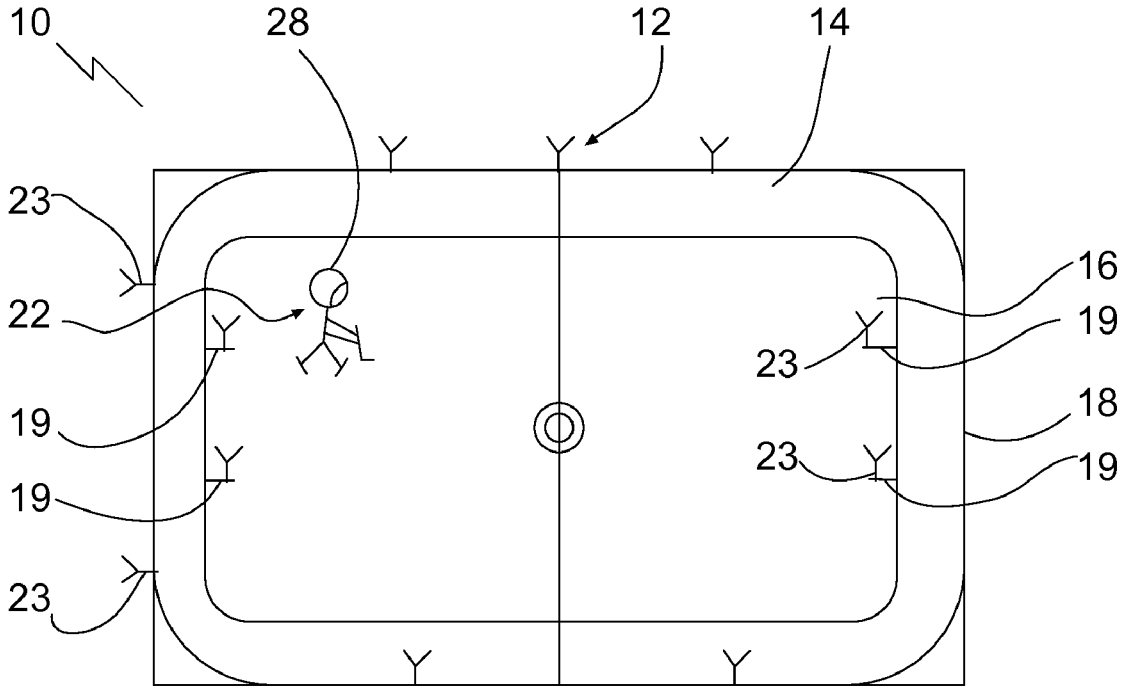
FIG. 3 is a top plan view of an alternative apparatus for preventing hitting in a restricted zone.

An apparatus for preventing hitting in a restricted zone during game play generally identified by reference numeral 10, will now be described with reference to FIGS. 1 and 3.

Figure 1:
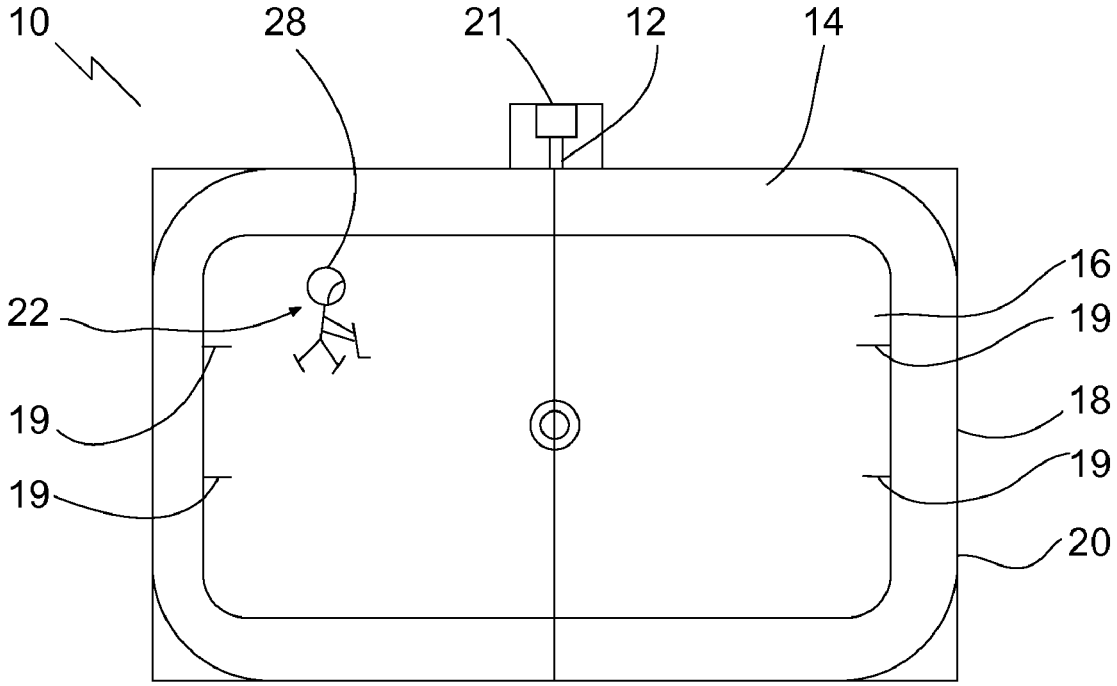
FIG. 1 is a top plan view of the apparatus for preventing hitting in a restricted zone.

Referring to FIG. 1, apparatus 10 includes a signal generator 12 for signaling the location of a restricted zone 14 in a playing area 16 contained by a barrier 18. One example of signal generator 12 is a wire 20 acting as an antenna that follows barrier 18 about playing area 16 connected to a transmitter 21 located in the timekeepers box. A current may then be run through wire 20 by transmitter 21, such that wire 20 generates a constant magnetic field or other type of signal. The strength of the magnetic field and therefore how far it extends at a detectable level will depend on the size of the current. Alternatively, referring to FIG. 3, discrete antennas 23 may be located about barrier 18, or at other locations of high risk, such as around goals posts 19. Other designs may also be used, as will be recognized by those skilled in the art. Playing area 16 may be a hockey rink or lacrosse field in which case barrier 18 would be the boards, or any other playing area in which injury may occur when contact occurs a certain distance from barrier 18. As apparatus 10 may be implemented with any level or size of player, the position and dimensions of restricted zone 14 will depend largely on the skill and size of the players involved in the game, but will generally be about 3-6 feet from the boards. As an example, the size of restricted zone 14 may be varied by adjusting the strength of the signal generated by signal generator 12.

Figure 2:
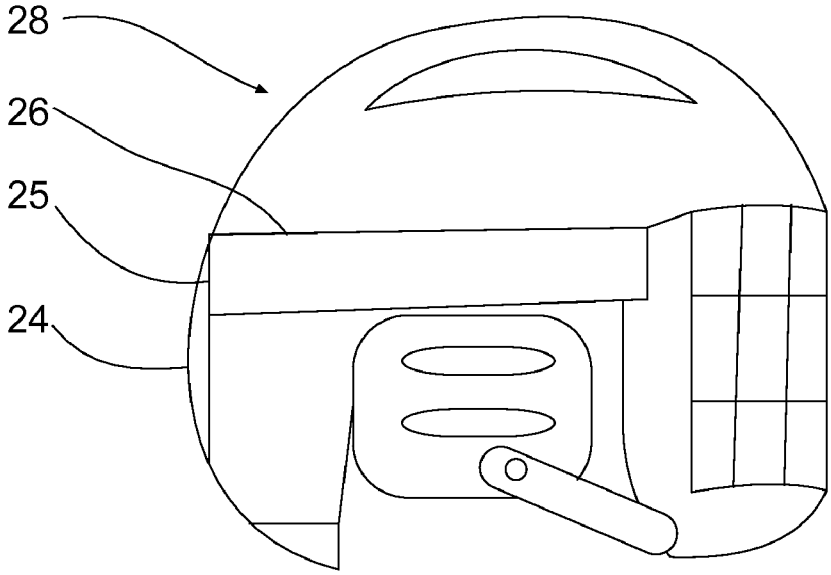
FIG. 2 is a side plan view of a hockey helmet, modified for use in accordance with the present method and apparatus.

In the preferred embodiment, referring to FIG. 2, each player 22 (shown in FIG. 1) carries a proximity detector 24 for receiving the signal generated by signal generator 12 and an indicator 25 which indicates when proximity detector 24 is within restricted zone 14. For example, with respect to FIG. 1, proximity detector 24 may act as a switch that activates indicator 25 to indicate the presence of a magnetic field of a certain strength, which would be detected when player 22 is within restricted zone 14. Proximity detector 24 may have multiple wires in case of failure of the main wires in use. Referring again to FIG. 2, indicator 25 is preferably one or more lights 26 located on the helmet 28 of player 22. Implementation would be made in conjunction with a rule that makes it is illegal to hit a player within restricted zone 14. Once lights 26 are activated, other players are made aware that the player is in restricted zone 14, and must govern themselves accordingly. This creates a greater awareness of the restricted zone for the players and simplifies rule enforcement for referees.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope defined in the Claims.

What is claimed is:

1. An apparatus for preventing hitting in a restricted zone during game play in a playing area enclosed and surrounded by a wall serving as a barrier that is a potential injury hazard to players, comprising in combination:

a signal generator for signalling the location of a restricted zone in the playing area a set distance from the barrier;

a proximity detector for receiving the signal generated by the signal generator, the proximity detector being carried by each player; and a visual indicator which indicates when the proximity detector is within the restricted zone, the visual indicator being visible on a helmet of each player;

wherein the game play in the playing area is such that hitting is allowed or disallowed based upon the status of the visual indicator on an opposing player's helmet.

2. The apparatus of claim 1, wherein the restricted zone also comprises a set distance from a goal post within the playing area.

3. The apparatus of claim 1, wherein the visual indicator is a light.

4. The apparatus of claim 1, wherein the signal generator is a wire.

5. The apparatus of claim 1, wherein the signal generator is a plurality of discrete antennas.

6. The apparatus of claim 1, wherein the proximity detector is carried on the player's helmet.

7. A method for preventing hitting in a restricted zone during game play in a playing area enclosed and surrounded by a wall serving as a barrier which is a potential injury hazard to players, the method comprising the steps of:

providing a signal generator for signalling the location of a restricted zone in the playing area a set distance from the barrier;

providing a proximity detector for receiving the signal generated by the signal generator, the proximity detector being carried by each player;

providing a visual indicator which indicates when the proximity detector is within the restricted zone, the visual indicator being visible on a helmet of each player; and playing a game in the playing area such that hitting is allowed or disallowed based upon the status of the visual indicator on an opposing player's helmet.

8. The method of claim 7, wherein the restricted zone also comprises a set distance from a goal post within the playing area.

9. The method of claim 7, wherein the visual indicator is a light.

10. The method of claim 7, wherein the signal generator is a wire.

11. The method of claim 7, wherein the signal generator is a plurality of discrete antennas.

12. The method of claim 7, wherein the proximity detector is carried on the player's helmet.

* * * * *